US010550810B2

(12) United States Patent
Kohashi

(10) Patent No.: US 10,550,810 B2
(45) Date of Patent: Feb. 4, 2020

(54) FUEL INJECTION VALVE

(71) Applicant: Toyota Jidosha Kabushiki Kaisha, Toyota-shi, Aichi-ken (JP)

(72) Inventor: Kenichi Kohashi, Shizuoka-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 155 days.

(21) Appl. No.: 15/953,944

(22) Filed: Apr. 16, 2018

(65) Prior Publication Data

US 2018/0313311 A1 Nov. 1, 2018

(30) Foreign Application Priority Data

Apr. 27, 2017 (JP) ..... 2017-088037

(51) Int. Cl.
*F02M 53/06* (2006.01)
*F02M 63/00* (2006.01)

(52) U.S. Cl.
CPC ..... *F02M 53/06* (2013.01); *F02M 63/0015* (2013.01)

(58) Field of Classification Search
CPC ..... F02M 53/06; F02M 63/0015; F02M 53/04
See application file for complete search history.

(56) References Cited

U.S. PATENT DOCUMENTS 6,561,168 B2 * 5/2003 Hokao ..... F02M 51/0682 123/41.31
2011/0100338 A1 5/2011 Vetrovec

FOREIGN PATENT DOCUMENTS

| | | | |
|---|---|---|---|
| DE | 102006024665 A1 | | 11/2007 |
| JP | S58-197462 A | | 11/1983 |
| JP | 2000-508041 A | | 6/2000 |
| JP | 2005-098232 A | | 4/2005 |
| JP | 2006336493 | * | 5/2005 |
| JP | 2006-194174 A | | 7/2006 |
| JP | 2006-336493 A | | 12/2006 |
| WO | 99/05411 A1 | | 2/1999 |
| WO | 2014174906 A1 | | 10/2014 |

* cited by examiner

*Primary Examiner* — Kevin A Lathers
(74) *Attorney, Agent, or Firm* — Dinsmore & Shohl LLP

(57) ABSTRACT

A fuel injection valve includes: a nozzle body portion; a valve body; and a valve seat. The valve body and the valve seat define a fuel space which is shielded from the fuel injection hole and is supplied with the fuel in a case where the valve body is in a state of being seated on a valve seat portion. The fuel space includes at least a space between a side surface of the valve body and a surface forming an accommodation space of the valve seat. The valve body and the valve seat are configured to cause the fuel space and the fuel injection bole to communicate with each other in a case where the valve body is in a state of being separated from the valve seat portion. A light irradiation portion is disposed at a position where the fuel space is irradiated with transmitted light.

9 Claims, 7 Drawing Sheets

THIRD EMBODIMENT

FUEL INJECTION VALVE

CROSS-REFERENCE TO RELATED APPLICATIONS

This application claims priority to Japanese Patent Application No. 2017-088037 filed on Apr. 27, 2017, which is incorporated herein by reference in its entirety including the specification, drawings and abstract.

BACKGROUND

1. Technical Field

The present disclosure relates to a fuel injection valve which is applied to, for example, an internal combustion engine and injects a liquid fuel.

2. Description of Related Art

A fuel injection valve which injects a fuel into a combustion chamber of an internal combustion engine is described in Japanese Unexamined Patent Application Publication No. 2006-336493 (JP 2006-336493 A). The fuel injection valve (hereinafter, referred to as an "injection valve of the related art") includes a fuel passage through which the fuel flows in the injection value of the related art. Furthermore, the injection valve of the related art includes a laser light irradiation device that enables laser light to enter the inside of the fuel passage.

In the injection value of the related art, solely a portion of a member forming the fuel passage is irradiated with the laser light that enters the inside of the fuel passage. The portion irradiated with the laser light generates heat. Hereinafter, the portion that generates heat is referred to as a "heat generation portion". The injection valve of the related art heats the fuel being in contact with the heat generation portion. As a result, the temperature of the injected fuel gradually increases, and thus the injection valve of the related art can promote atomization of fuel spray.

However, in the injection valve of the related art, the position of the heat generation portion is "substantially the central portion of a columnar needle valve in its longitudinal direction". That is, the position of the heat generation portion is separated from a fuel injection hole by a relatively long distance. For this reason, the distance from the fuel heated at the heat generation portion to the fuel injection hole is relatively long, so that the heat of the fuel is dissipated to the member forming the fuel passage. As a result, in the injection valve of the related art, there is a problem that a large amount of energy is needed to increase the temperature of the fuel spray injected from the fuel injection hole. In other words, there is a problem that the injection valve of the related art cannot efficiently increase the temperature of the fuel spray.

SUMMARY

The present disclosure provides a fuel injection valve capable of efficiently increasing the temperature of fuel spray.

An aspect of the present disclosure relates to a fuel injection valve including a nozzle body portion having a hollow columnar shape, a columnar valve body disposed inside the nozzle body portion to move along an axial direction of the nozzle body portion, a valve seat disposed in the vicinity of a tip portion inside the nozzle body portion, a valve body driving portion configured to move the valve body between a position where the valve body is seated on a valve seat portion of the valve seat and a position where the valve body is separated from the valve seat portion, a light source having a light emitting portion which generates light when the light emitting portion is energized, a pipe portion disposed in a base end portion, which is an end portion on the opposite side to the tip portion of the nozzle body portion in which a fuel injection hole is formed, and a light transmission portion configured to receive light generated by the light source from a light introduction portion and transmit the received light to a light irradiation portion to cause the transmitted light to be emitted from the light irradiation portion. The nozzle body portion includes the fuel injection hole at the tip portion of the nozzle body portion. The valve seat includes an accommodation space into which a tip portion of the valve body is inserted. The pipe portion is disposed coaxially with the nozzle body portion to be in contact but is an integrated body or a separate body. The pipe portion is configured to supply a fuel to the nozzle body portion through the pipe portion.

The valve body and the valve seat define a fuel space which is shielded from the fuel injection hole and is supplied with the fuel in a case where the valve body is in a state of being seated on the valve seat portion. The fuel space includes at least a space between a side surface of the valve body and a surface forming the accommodation space of the valve seat. The valve body and the valve seat are configured to cause the fuel space and the fuel injection hole to communicate with each other in a case where the valve body is in a state of being separated from the valve seat portion. The light emitting portion is disposed at a position in direct or indirect contact with the pipe portion. The light irradiation portion is disposed at a position where at least a portion of the fuel space is irradiated with the transmitted light.

According to the aspect of the present disclosure, the light irradiation portion is disposed at a position where at least a portion of the fuel space is irradiated with the transmitted light. The fuel is supplied to the fuel space. When the valve body is separated from the valve seat portion, since the fuel space and the fuel injection hole communicate with each other, the fuel is injected from the fuel injection hole. Therefore, the fuel supplied to the fuel space is a fuel present in the space through which the fuel passes just before the injection. Therefore, the light emitted from the light irradiation portion to at least a portion of the fuel space heats solely the fuel present in the fuel space (that is, the fuel present in the space just before the injection). For this reason, for example, compared to a case where the entirety of the fuel present in at least one of the inside of the valve body and the inside of the nozzle body portion is heated as in an injection valve of the related art, the fuel in the space just before the injection can be efficiently heated. Furthermore, since the distance between the fuel space and the fuel injection hole is extremely short, the heat of the heated fuel is hardly dissipated. As a result, the fuel injection valve according to the aspect of the present disclosure can efficiently increase the temperature of fuel spray using less energy.

Furthermore, according to the aspect of the present disclosure, the light emitting portion is disposed at a position in direct or indirect contact with the pipe portion. The fuel is supplied to the nozzle body portion through the hollow portion of the pipe portion. Therefore, heat dissipated from the light emitting portion can be dissipated to the fuel passing through the hollow portion in the pipe portion via the pipe portion. Accordingly, the heat dissipated from the light emitting portion can increase the temperature of the fuel. That is, before the increase in the temperature of the fuel by light irradiation on the downstream side of the fuel injection valve, the temperature of the fuel can also be increased on the upstream side of the fuel injection valve. As a result, the efficiency of heating the fuel can be further improved.

The fuel injection valve according to the aspect of the present disclosure may further include a light-transmissive member which is made of a light-transmissive material and is disposed between an outer side surface of the valve body and an inner side surface of the nozzle body portion to be in contact with a surface of the valve seat on the opposite side to the fuel injection hole and close an opening formed by the outer side surface of the valve body and the inner side surface of the nozzle body portion. The fuel space may include an extension passage which is provided inside the valve seat and extends from the space to the light-transmissive member. The light irradiation portion may be disposed at a position where the extension passage is irradiated with the transmitted light through the light-transmissive member.

According to the aspect of the present disclosure, since the light-transmissive member is provided between the light-irradiation portion and the end portion of the extension passage, while the fuel in the extension passage is irradiated with light emitted from the light irradiation portion through the light-transmissive member, the terminal end of light transmission of the light transmission portion (the periphery of the light irradiation portion) can be reliably sealed by the light-transmissive member. As a result, infiltration of the fuel into at least one of the light transmission portion from the periphery of the light irradiation portion or the periphery of the light transmission portion can be sufficiently suppressed.

In the fuel injection valve according to the aspect of the present disclosure, the valve body driving portion may include a core member disposed inside the nozzle body portion, a spring disposed inside the nozzle body portion and has a first end that is supported so as not to move relative to the nozzle body portion, an armature which is disposed inside the nozzle body portion to cause a second end of the spring to be locked to the armature and holds the valve body, and a solenoid disposed outside the nozzle body portion to surround an outer circumference of the core member.

The pipe portion may be disposed in the base end portion coaxially with the nozzle body portion to be in contact but may be a separate body. The light emitting portion may be fixed to an outer side surface of the pipe portion. The light transmission portion may be disposed such that the light introduction portion is disposed at a side of the pipe portion and extends in parallel to the center axis of the nozzle body portion.

According to the aspect of the present disclosure, the light emitting portion is disposed on the outer side surface of the tubular pipe portion which is disposed in the base end portion coaxially with the nozzle body portion to be in contact but is a separate body. On the other hand, the valve body driving portion including members needed for driving the valve body (that is, the core member, the spring, the armature, and the solenoid) is disposed in the nozzle body portion. Therefore, the light emitting portion can be provided in the fuel injection valve without changing the dimensions of the members related to fuel injection characteristics (that is, the nozzle body portion in which the valve body driving portion is disposed and the valve body). Therefore, the nozzle body portion, the valve body driving portion, and the valve body can be made common to a fuel injection valve which is not provided with a light emitting portion and the fuel injection valve according to the aspect. In other words, there is no need to particularly design components related to fuel injection in order to provide the light emitting portion in the fuel injection valve. As a result, the cost of the fuel injection valve according to the aspect of the present disclosure can be further reduced.

Furthermore, according to the aspect of the present disclosure, the distance between the light emitting portion and the space where the fuel is heated is long. However, the light transmission portion is disposed between the light emitting portion and the space. Therefore, the loss of light energy due to the light transmission can be further reduced. For this reason, the energy efficiency when the fuel is heated can be maintained at a higher value.

In the fuel injection valve according to the aspect of the present disclosure, the pipe portion may be made of a material having a higher thermal conductivity than the nozzle body portion.

According to the aspect of the present disclosure, since the thermal conductivity of the pipe portion is relatively high, heat generated when the light emitting portion emits light can be efficiently dissipated to the fuel passing through the pipe portion via the pipe portion. As a result, the light emitting portion can be effectively cooled. Furthermore, the fuel can be effectively heated by the heat. Therefore, according to the aspect described above, the efficiency of heating the fuel can be further improved.

In the fuel injection valve according to the aspect of the present disclosure, the light transmission portion may include an optical fiber. The nozzle body portion may include a light transmission portion space through which the optical fiber passes, and may include a resin filling a gap between the optical fiber and a surface forming the light transmission portion space.

According to the aspect of the present disclosure, since the optical fiber is fixed to the nozzle body portion by the resin, a possibility of disconnection of the optical fiber due to vibration can be further reduced. Furthermore, since a possibility of infiltration of the fuel to the periphery of the optical fiber can be further reduced, a possibility of deterioration of the optical fiber can be further reduced.

In the fuel injection valve according to the aspect of the present disclosure, the light transmission portion may be a light transmission portion space formed in the nozzle body portion. A surface forming, the light transmission portion space may be a mirror surface.

According to the aspect of the present disclosure, since an additional light transmission member such as an optical fiber for forming the light transmission portion is not needed, the fuel injection valve can be formed with a smaller number of components.

The fuel injection valve according to the aspect of the present disclosure may further include a sealing member which seals a space formed by the side surface of the valve body and the inner side surface of the nozzle body portion on the opposite side of the light-transmissive member from the valve seat, and seals the light transmission portion space.

According to the aspect of the present disclosure, since the space and the light transmission portion space can be reliably sealed (shielded) by the sealing member, infiltration of the fuel in the space into the light transmission portion space can be sufficiently suppressed.

In the fuel injection valve according to the aspect of the present disclosure, the light source may include a reflecting portion which reflects light emitted from the light emitting portion to cause the light to be concentrated on the light introduction portion.

According to the aspect of the present disclosure, the light generated by the light emitting portion can be efficiently concentrated on the light introduction portion by the reflecting portion. Therefore, the loss of light energy can be further reduced, and the efficiency of heating the fuel can be further improved.

In the fuel injection valve according to the aspect of the present disclosure, the light, source may include a cover portion that covers the light emitting portion and the reflecting portion. An inner surface of the cover portion may be a mirror surface.

According to the aspect of the present disclosure, the light emitting portion and the reflecting portion can be protected from external substances such as sand and dust by the cover portion. Furthermore, since the inner surface of the cover portion is the mirror surface, an increase in the temperature of the cover portion due to light can be sufficiently suppressed, and at least a portion of the light reflected on the mirror surface can be guided to the light introduction portion, thereby further reducing the loss of light energy.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Figure 1:
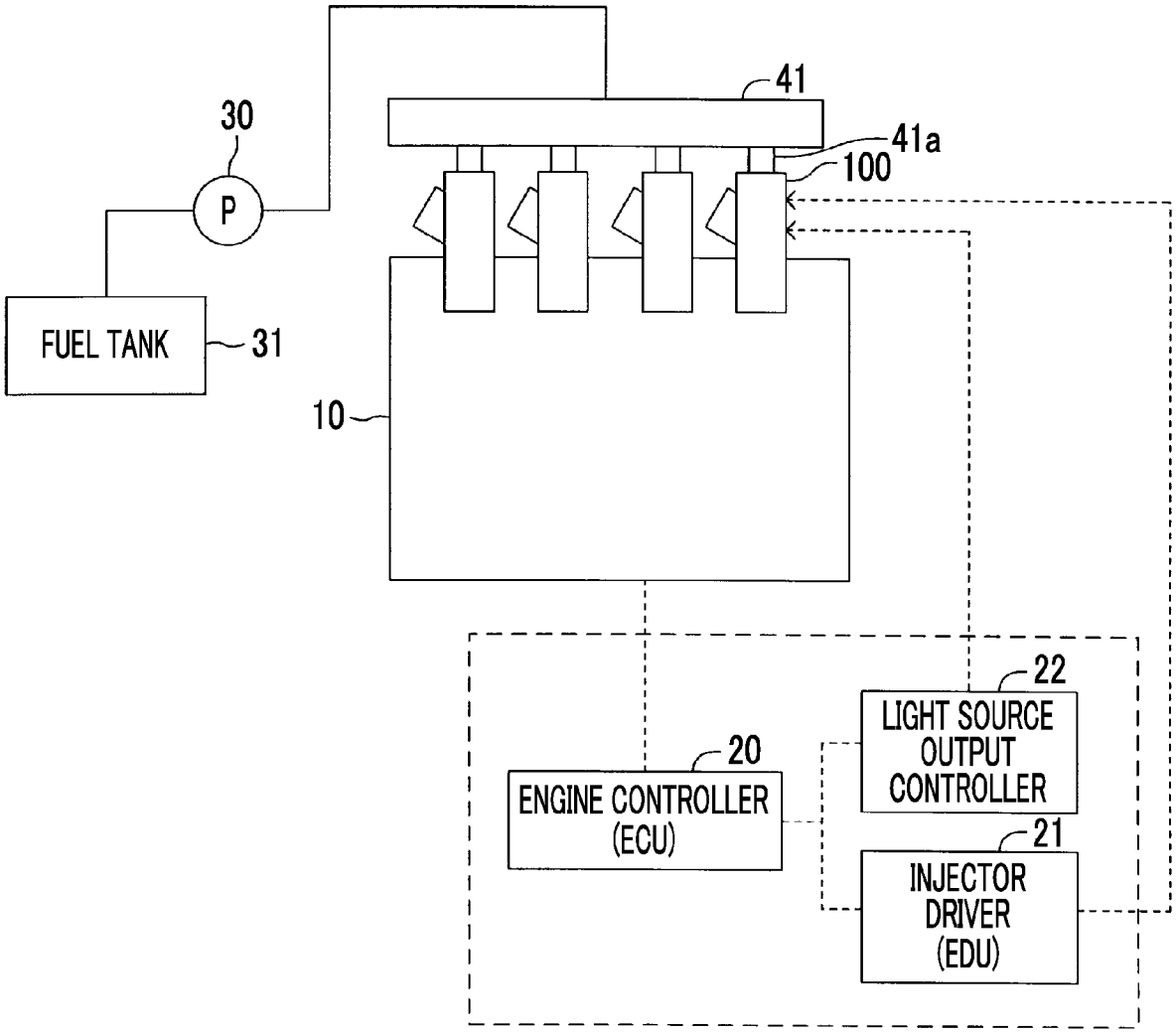
FIG. 1 is an overall view of an internal combustion engine to which a fuel injection valve according to a first embodiment (first fuel injection valve) of the present disclosure is applied.

Hereinafter, a fuel injection valve according to each of embodiments of the present disclosure will be described with reference to the drawings. In all the drawings of the embodiments, like elements which are similar or correspond to each other are denoted by like reference numerals.

First Embodiment

A fuel injection valve according to a first embodiment (hereinafter, referred to as "first fuel injection valve") of the present disclosure will be described. A first fuel injection valve 100 is applied to an "internal combustion engine 10 illustrated in FIG. 1" mounted in a vehicle (not illustrated).

The internal combustion engine 10 is a multi-cylinder (in this example, four-cylinder), four-cycle, spark-ignition, electronic control fuel injection type gasoline engine. The internal combustion engine 10 includes "a plurality of combustion chambers, intake ports respectively connected to the combustion chambers, intake pipes connected to the intake ports, exhaust ports respectively connected to the combustion chambers, and exhaust pipes connected to the exhaust ports", all of which are not illustrated.

The first fuel injection valve 100 is disposed in a cylinder head portion to directly inject a fuel into each of the combustion chambers. Here, the first fuel injection valve 100 may also be disposed in each of the intake ports to inject the fuel into each of the intake ports.

In the vehicle (not illustrated), an electronic control unit (ECU) 20 as an engine controller, an electronic drive unit (EDU) 21 as an injector driver, a light source output controller 22, a fuel pump 30, a fuel tank 31, and a delivery pipe 41 are further mounted.

The ECU 20 is an electronic circuit including a well-known microcomputer, and includes a central processing unit (CPU), a read-only memory (ROM), a random-access memory (RAM), a backup RAM, an interface, and the like. The ECU 20 is connected to the EDU 21. The ECU 20 controls the first fuel injection valve 100 via the EDU 21 by sending a fuel injection control signal for causing the first fuel injection valve 100 to inject the fuel, to the EDU 21. The EDU 21 may be provided in the ECU 20.

The EDU 21 is connected to a solenoid 139 illustrated in FIG. 2, which will be described later, included in the first fuel injection valve 100. The EDU 21 sends a drive signal (valve opening command signal) for driving the solenoid 139 to the solenoid 139 in response to the fuel injection control signal from the ECU 20.

The ECU 20 is connected to the light source output controller (light source control unit, or light source controller) 22. The light source output controller 22 controls the magnitude of current flowing through light emitting portions 122 illustrated in FIG. 2, which will be described later. The ECU 20 calculates a needed fuel heating amount based on parameters representing the state of the internal combustion engine 10 acquired by various sensors (not illustrated) connected to the ECU 20, and sends a control signal representing the calculated fuel heating amount to the light source output controller 22. The light source output controller 22 controls the magnitude of the current flowing through the light emitting portion 122 in response to the control signal representing the fuel beating amount.

The fuel pump 30 feeds the fuel in the fuel tank 31 to the delivery pipe 41 by being rotated by a motor (not illustrated). Therefore, the fuel at a high pressure is stored in the delivery pipe 41. The fuel at a high pressure is supplied to the first fuel injection valve 100 via a pipe 41*a* connected to each of the first fuel injection valves 100. The first fuel injection valve 100 is opened in response to the drive signal sent from the EDC 21 based on the fuel injection control signal from the ECU 20, and the fuel is injected by opening the first fuel injection valve 100.

Configuration of First Fuel Injection Valve

Figure 2:
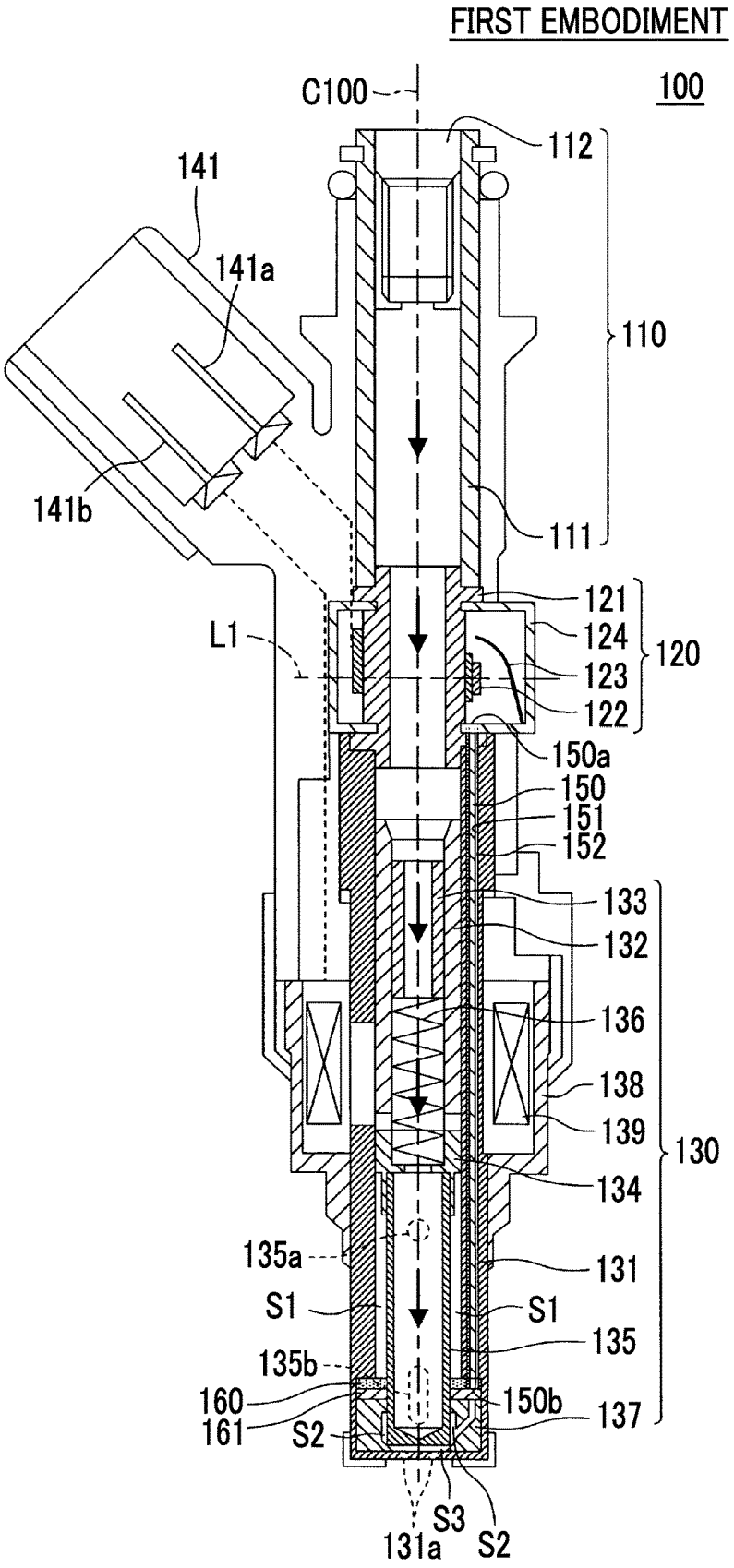
FIG. 2 is a longitudinal sectional view of the fuel injection valve illustrated in FIG. 1.

As illustrated in FIG. 2, the first fuel injection valve 100 includes a fuel introduction portion 110, a light source 120, and a nozzle portion 130.

The fuel introduction portion 110, the light source 120, and the nozzle portion 130 have spaces (fuel passages) which communicate with each other and cause the fuel to pass therethrough. That is, the fuel is supplied to the fuel introduction portion 110 illustrated in FIG. 2 from the delivery pipe 41 illustrated in FIG. 1. As indicated by arrows in FIG. 2, the fuel passes through the respective fuel passages of the fuel introduction portion 110, the light source 120, and the nozzle portion 130 and reaches a fuel injection hole 131*a* formed at the tip of the first fuel injection valve 100. Therefore, when the fuel injection hole 131*a* is opened, the fuel is injected from the fuel injection hole 131*a* toward the outside.

Fuel Introduction Portion

The fuel introduction portion 110 includes a first pipe portion 111. The first pipe portion 111 is made of metal and has a substantially hollow columnar shape (cylindrical shape) having a center axis C100. A first end and a second end of the first pipe portion 111 are open. A portion in the vicinity of the first end of the first pipe portion 111 forms an inlet 112. The first pipe portion 111 is connected to the pipe 41*a* illustrated in FIG. 1 at the inlet 112. Hereinafter, there may be cases where the inlet 112 side relative to the fuel injection hole 131*a* is expressed as an upper side, and the fuel injection hole 131*a* side relative to the inlet 112 is expressed as a lower side. The upper end portion of a certain member is also referred to as an "upper end", and the lower end portion of the member is also referred to as a "lower end". Therefore, the upper end of the first pipe portion 111 is connected to the pipe 41*a*.

Light Source

The light source 120 includes a second pipe portion 121, the light emitting portion 122 (light source), a plurality of condensing mirrors (reflecting portions) 123, and a cover portion 124.

The second pipe portion 121 has a substantially hollow columnar shape (cylindrical shape) having the center axis C100. The upper end (first end) and the lower end (second end) of the second pipe portion 121 are open. The upper end of the second pipe portion 121 is joined to the lower end of the first pipe portion 111.

The second pipe portion 121 is made of a metal having a relatively high thermal conductivity (for example, an aluminum alloy or a copper alloy). The heat transfer rate of the second pipe portion 121 is higher than the heat transfer rate of any of the first pipe portion 111 and a nozzle body portion 131, which will be described later. The second pipe portion 121 has a function of a heat sink which dissipates heat by transferring heat generated when the light emitting portion 122 emits light to the fuel passing through tire fuel passage inside the second pipe portion 121. Therefore, the heat generated by the light emitting portion 122 can be effectively used "to heat the fuel". Although not illustrated in the figure, a plurality of fins for further improving the efficiency of thermal conduction to the fuel may be provided on the inner side surface of the second pipe portion 121.

Figure 3A:
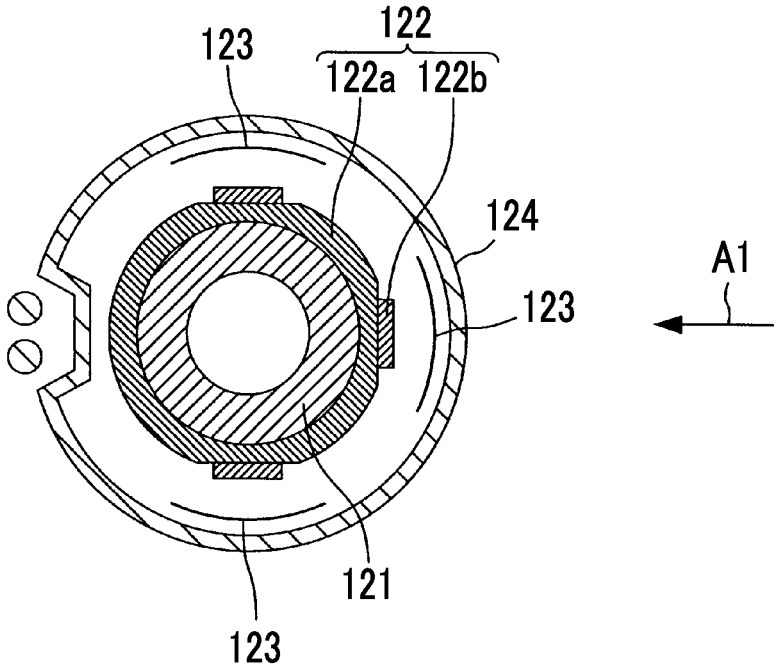
FIG. 3A is a schematic cross-sectional view of the first fuel injection valve cut along a plane along line L1 illustrated in FIG. 2.
Figure 3B:
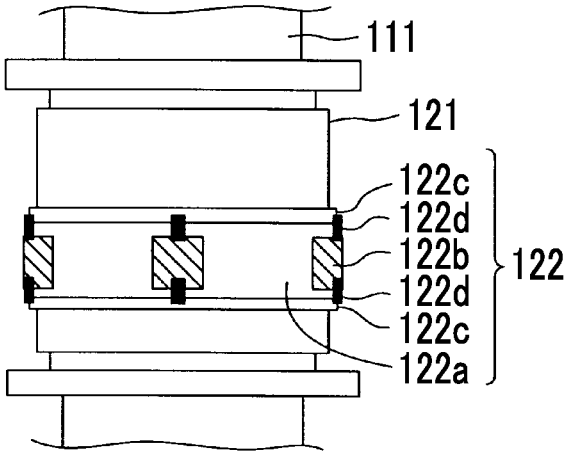
FIG. 3B is a schematic external view of a light emitting portion taken along arrow A1 in FIG. 3A.

The light emitting portion 122 is disposed on the outer side surface of the second pipe portion 121. More specifically, as illustrated in FIGS. 3A and 3B, the light emitting portion 122 includes a substrate 122*a*, a plurality of (in this example, three) light emitting elements 122*b*, a pair of conducting wire portions 122*c*, and a pair of connecting portions 122*d* for each of the light emitting elements 122*b*. FIG. 3B is a view of the light emitting portion 122 viewed along arrow A1 in FIG. 3A.

The substrate 122*a* is made of a material having a relatively high heat transfer rate. The substrate 122*a* is disposed in a substantially band shape on the outer side surface of the second pipe portion 121 so as to be in close contact, with the outer side surface of the second pipe portion 121 and surround the outer circumference of the second pipe portion 121.

The light emitting elements 122*b* are elements that have substantially rectangular plate shapes, which are the same, and emit light when energized. In this example, the light emitting, element 122*b* is a light emitting diode (LED), and the type of light emitted by the LED (light emitting element) 122*b* is light suitable for heating (for example, ultraviolet light or infrared light). Each of the LEDs 122*b* is disposed on the outer side surface of the substrate 122*a*. The LEDs 122*b* are arranged in a state of being separated from each other along the circumferential direction of the second pipe portion 121. Therefore, the LEDs 122*b* are disposed at equal distances from the tip portion (for example, the fuel injection hole 131*a*) of the first fuel injection valve 100 in a direction parallel to the center axis C100. As described above, the LEDs 122*b* are arranged along the circumferential direction of the second pipe portion 121. Therefore, there is an advantage that even in a case where the LEDs 122*b* are provided in the first fuel injection valve 100, this does not increase the overall length of the first fuel injection valve 100 (the length along the center axis C100).

One of the conducting wire portions 122*c* has a thin band shape and is disposed on the outer side surface of the substrate 122*a* to surround the substrate 122*a* in the vicinity of the upper end portion of the substrate 122*a*. The one of the conducting wire portions 122*c* is electrically connected to a first, terminal 141*a* of a connector 141 illustrated in FIG. 2. The other of the conducting wire portions 122*c* has a thin band shape and is disposed on the outer side surface of the substrate 122*a* to surround the substrate 122*a* in the vicinity of the lower end portion of the substrate 122*a*. The other of the conducting wire portions 122*c* is electrically connected to the second pipe portion 121 via a conducting wire portion (not illustrated). Each of the LEDs 122*b* is disposed between the conducting wire portions 122*c*. Each of the LEDs 122*b* is electrically connected to the conducting wire portions 122*c* via the connecting portions 122*d*.

As illustrated in FIGS. 2 and 3A, each of the condensing mirrors 123 is disposed between the outer side surface of the second pipe portion 121 and the inner side surface of the cover portion 124. The condensing mirror 123 is a curved thin plate body and is configured to face the light emitting portion 122 and cover the light emitting portion 122. The surface of the condensing mirror 123 facing the light emitting portion 122 is a mirror surface. Therefore, the condensing mirror 123 has an angle and a shape such that the condensing mirror 123 reflects light emitted from the LED 122*b* and the reflected light is concentrated on a "light introduction portion 150*a*, which forms the start point of a light transmission path which is the upper end (first end) of a light transmission portion 150".

The cover portion 124 is made of metal and has a substantially hollow columnar shape (cylindrical shape) having the center axis C100. Although both the upper end (first end) and the lower end (second end) of the cover portion 124 are closed, a circular hole is provided in the upper end (first end) and the lower end (second end) of the cover portion 124. The cover portion 124 is fixed to the second pipe portion 121 so as to cover the light emitting portion 122 and the condensing mirrors 123 in a state in which the second pipe portion 121 is inserted through the hole. In other words, the light emitting portion 122 and the condensing mirrors 123 are accommodated in a closed space formed between the outer side surface of the second pipe portion 121 and the inner side surface of the cover portion 124.

The cover portion 124 has a function of suppressing leakage of light emitted by the light emitting portion 122 to the outside of the first fuel injection valve 100 and a function of protecting the light emitting portion 122 and the condensing mirrors 123 from external substances such as sand and dust. The cover portion 124 is formed of a material that can be subjected to mirror surface processing, and the inner side surface of the cover portion 124 is a mirror surface. As described above, heating and deterioration of the cover portion 124 due to the "light emitted by the light emitting portion 122" can be sufficiently suppressed. Furthermore, the cover portion 124 reflects light applied to the mirror surface of the cover portion 124 on the mirror surface such that, a portion of the reflected light is directed to the light introduction portion 150*a*. The inner side surface of the cover portion 124 may not be a mirror surface. In this above, the cover portion 124 may be made of a material (for example, resin) that cannot be subjected to mirror surface processing.

Nozzle Portion

The nozzle portion 130 includes the nozzle body portion 131, a core member 132, an inner collar 133, an armature 134, a needle valve 135, a spring 136, a valve seat 137, an outer case 138, and the solenoid 139.

The nozzle body portion 131 is made of metal and has a substantially hollow columnar shape (cylindrical shape) having the center axis C100. The upper end (first end) of the nozzle body portion 131 is open. The lower end (second end) of the nozzle body portion 131 is closed. The upper end of the nozzle body portion 131 is joined to the lower end of the second pipe portion 121 and a portion of the wall of the lower side of the cover portion 124. A through-hole sewing as the fuel injection hole 131*a* is formed in the wall of the lower end of the nozzle body portion 131.

The core member 132 is made of a magnetic material (in this example, iron) and has a substantially hollow columnar shape (cylindrical shape) having the center axis C100. The upper end (first end) and the lower end (second end) of the core member 132 are open. The core member 132 is fixed to the nozzle body portion 131 such that the outer circumferential surface of the core member 132 abuts the inner circumferential surface of the nozzle body portion 131.

The inner collar 133 is made of metal and has a substantially hollow columnar shape (cylindrical shape) having the center axis C100. The length of the inner collar 133 in a direction along the center axis C100 is shorter than the length of the core member 132 in the direction along the center axis C100. The upper end (first end) and the lower end (second end) of the core member 132 are open. The inner collar 133 is fixed to the core member 132 such that the outer circumferential surface of the inner collar 133 abuts the inner circumferential surface of the core member 132. The inner collar 133 is disposed in a portion above the central portion of the core member 132 in the direction along the center axis C100.

The armature 134 is made of a magnetic material (in this example, iron) and has an upper portion having a hollow columnar shape with a relatively large diameter and the center axis C100 and a lower portion having a hollow columnar shape with a relatively small diameter and the center axis C100. The upper portion of the armature 134 is disposed to be slidable relative to the nozzle body portion 131. The upper end and the lower end of the armature 134 are open. A through-hole is formed in the partition wall between the upper portion and the lower portion of the armature 134.

The needle valve (valve body) 135 is made of metal and has a substantially hollow columnar shape (cylindrical shape) having the center axis C100. The upper end (first end) of the needle valve 135 is open. The lower end (second end) of the needle valve 135 is closed. The outer diameter of the needle valve 135 is smaller than the inner diameter of the nozzle body portion 131. The upper portion of the needle valve 135 is joined to the lower portion of the armature 134. Therefore, the needle valve 135 can move inside the nozzle body portion 131 integrally with the armature 134 along the center axis C100. A first communication hole 135*a* and a second communication hole 135*b* are respectively formed at a position near the upper end of the needle valve 135 and a position near the lower end thereof. The first communication hole 135*a* has a circular shape, and the second communication hole 135*b* has an oval shape.

The spring (coil spring) 136 is an elastic member disposed between the lower end of the inner collar 133 and the partition wall of the armature 134 in the internal space of the core member 132. The upper end of the spring 136 is fixed to the inner collar 133. The lower end of the spring 136 is locked to the armature 134. The spring 136 is compressed and biases the armature 134 and the needle valve 135 toward the second end (lower end) of the nozzle body portion 131.

The valve seat 137 is made of metal and has a substantially solid columnar shape having the center axis C100. The outer diameter of the valve seat 137 coincides with the inner diameter of the nozzle body portion 131. In the valve seat 137, an accommodation space into which the tip portion of the needle valve 135 is inserted is formed. That is, in the upper portion of the valve seat 137, a columnar accommodation hole into which the tip portion of the needle valve 135 is inserted is formed. In the lower portion of the valve seat 137, a space having an inverted truncated cone shape connected to the accommodation hole of the valve seat 137 is formed. Inclined surface portions which form the inverted truncated cone shape space in the vicinity of the tip portion of the inside of the valve seat 137 constitute a valve seat portion (seating portion) on which the tip corner portion of the needle valve 135 abuts (seats).

The outer case 138 has an upper portion having a hollow columnar shape (cylindrical shape) with a relatively large diameter and the center axis C100 and a lower portion having a hollow columnar shape (cylindrical shape) with a relatively small diameter and the center axis C100. The upper end (first end) and the lower end (second end) of the outer case 138 are open. The inner diameter of the upper portion of the outer case 138 is larger than the outer diameter of the nozzle body portion 131 and forms a space that accommodates the solenoid 139. The inner diameter of the lower portion of the outer case 138 is substantially coincident with the outer diameter of the nozzle body portion 131. In the outer case 138, the lower portion of the outer case 138 is joined to the nozzle body portion 131.

The solenoid 139 is disposed to be buried in the resin filling the space between the nozzle body portion 131 and the upper portion of the outer case 138. The solenoid 139 is electrically connected to a second terminal 141*b* or the connector 141. When current flows through the solenoid 139 (when the solenoid 139 is energized), the armature 134 moves upward together with the needle valve 135 against the biasing force of the spring 136 such that the tip corner portion of the needle valve 135 is separated from the valve seat portion of the valve seat 137. When no current flows through the solenoid 139, the armature 134 moves downward together with the needle valve 135 by the biasing force of the spring 136 such that the tip corner portion of the needle valve 135 abuts (seats) on the valve seat portion of the valve seat 137.

As described above, in the cavity formed in the nozzle body portion 131, the core member 132 having a tubular shape, the inner collar 133 having a tubular shape, the spring 136 as the elastic member, the armature 134, the needle valve 135, and the valve seat 137 are sequentially arranged in a direction from the light source 120 toward the tip portion of the nozzle body portion 131 along the center axis C100.

A space S1 is formed between the inner circumferential surface of the nozzle body portion 131 and the outer circumferential surface of the needle valve 135. The space S1 communicates with the internal space of the needle valve 135 through the first communication hole 135*a* and the second communication hole 135*b*.

Figure 4:
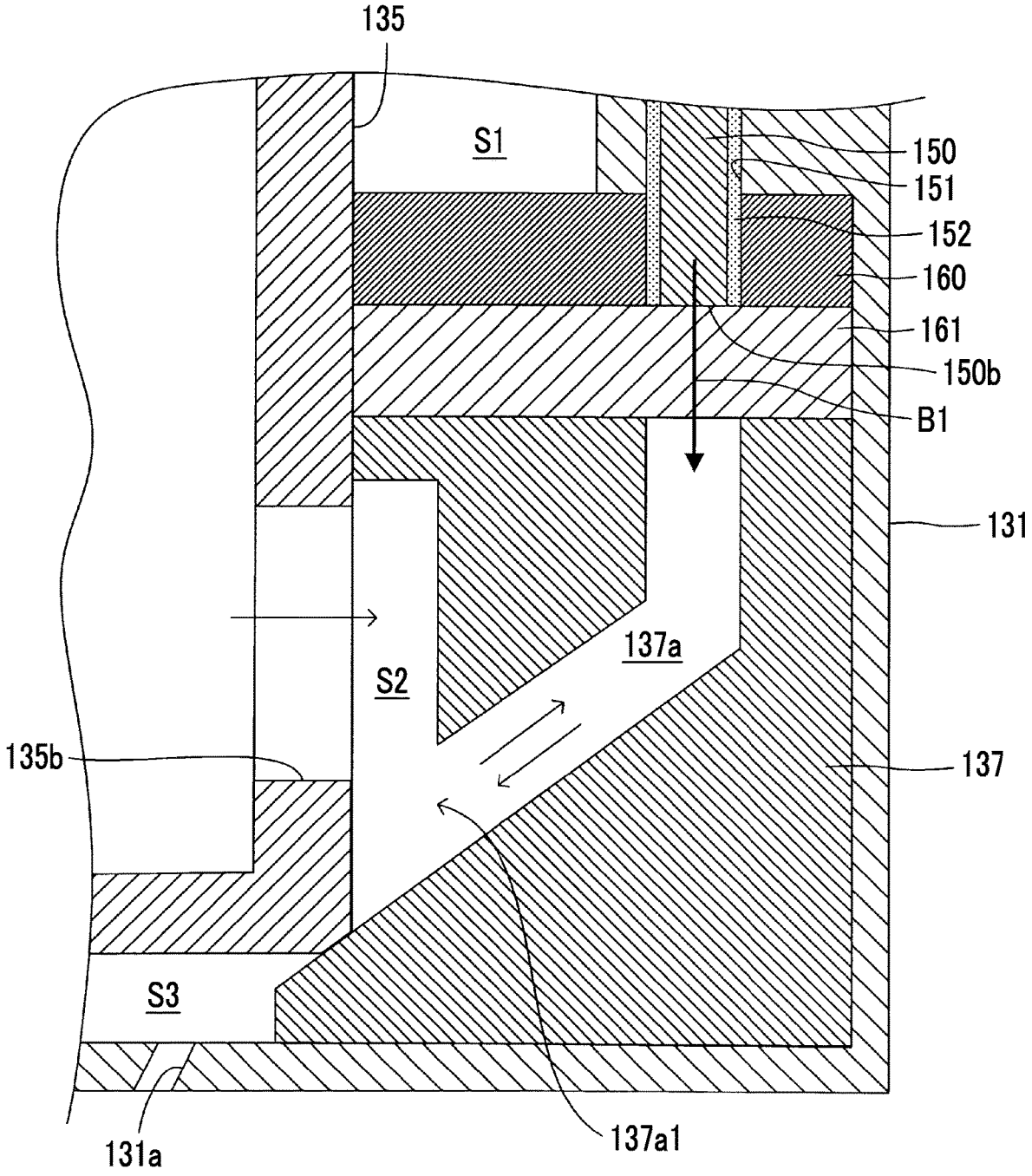
FIG. 4 is an enlarged schematic sectional view illustrating a portion of the fuel injection valve.

As illustrated in FIGS. 2 and 4, a space S2 is formed between the inner circumferential surface of a portion higher than the seating portion of the valve seat 137, the upper portion of the inclined surface forming the valve seat portion of the valve seat 137 (the surface forming the accommodation space), and the outer circumferential surface of the needle valve 135. The space S2 communicates with the internal space of the needle valve 133 through the second communication hole 135*b*.

Furthermore, a space S3 is formed by the outer wall surface of the lower end (tip) of the needle valve 135, the inclined surface forming, the valve seat portion of the valve seat 137, and the inner wall surface of the lower end (tip) of the nozzle body portion 131. The space S3 communicates with the space S2 when the needle valve 135 is at a position separated from the valve seat portion of the valve seat 137 (that is, when the fuel is injected from the fuel injection hole 131*a*). The space S3 communicates with the fuel injection hole 131*a*.

In the first fuel injection valve 100 configured as described above, as indicated by the arrows in FIG. 2, the fuel supplied to the inlet 112 from the pipe 41*a* flows through the respective internal spaces of the first pipe portion 111, the second pipe portion 121, the upper portion of the nozzle body portion 131, the upper portion of the core member 132, the inner collar 133, the lower portion of the core member 132, and the armature 134 into the internal space of the needle valve 135. The fuel filling the internal space of the needle valve 135 is supplied to the space S1 through the first and second communication holes 135*a*, 135*b* and is supplied to the space S2 through the second communication hole 135*b*. Therefore, when the tip corner portion of the needle valve 135 is separated from the valve seat portion of the valve seat 137 by energization of the solenoid 139, the fuel in the space S2 is supplied to the space S3 and reaches the fuel injection hole 131*a* such that the fuel is injected to the outside of the first fuel injection valve 100 through the fuel injection hole 131*a*. The spaces S1, S2, S3 are also called "fuel spaces" for convenience.

Light Transmission Portion and Light Irradiation Portion

The first fuel injection valve 100 further includes a light transmission portion 150, a sealing member 160, and a light-transmissive member 161.

The light transmission portion 150 is formed of a member that can transmit light through repeated reflection of at a relatively high reflectance. Specifically, the light transmission portion 150 is an optical fiber. The light transmission portion 150 is provided to correspond to each of a plurality of the light emitting portions 122.

The light transmission portion 150 is disposed in a relatively thin tubular space (passage) 151 formed in the wall of the nozzle body portion 131 to extend in parallel to the center axis C100. The space 151 is also called a light transmission portion space 151. The light transmission portion 150 and the surface forming the light transmission portion space 151 are separated from each other. The gap between the light transmission portion 150 and the surface forming the light transmission portion space 151 is filled with, a resin (for example, epoxy resin) 152 for fixing the light transmission portion 150. By fixing the light transmission portion 150 to the nozzle body portion 131 with the resin 152, disconnection of the light transmission portion 150 due to vibration or the like can be suppressed as much as possible.

As illustrated in FIG. 2, the upper end (first end) 150*a* of the light transmission portion 150 is disposed at a position at which the light emitted by the light emitting portion 122 arrives and forms the light introduction portion 150*a*. In this example, the light introduction portion 150*a* passes through a through-hole formed in the wall of the lower side of the cover portion 124 and is exposed to the upper surface of the wall of the lower side thereof. That is, the light introduction portion 150*a* is exposed to a space formed between the outer side surface of the second pipe portion 121 and the inner side surface of the cover portion 124 and is disposed immediately below the light emitting portion 122.

As illustrated in FIGS. 2 and 3, a lower end (second end) 150*b* of the light transmission portion 150 penetrates through the sealing member 160 and reaches the upper surface (one end surface) of the light-transmissive member 161. The lower end 150*b* forms a light irradiation portion 150*b*. Therefore, the light emitted by the light emitting portion 122 is transmitted from the light introduction portion 150*a* to the light-transmissive member 161 and is emitted from the light irradiation portion 150*b*.

The sealing member 160 is a circular plate body (aluminum gasket) made of aluminum. A through-hole is formed in the center of the sealing member 160. The wall surface of the outer side of the needle valve 135 is slidably inserted through the through-hole. The sealing member 160 is fitted into the nozzle body portion 131. The outer side surface of the sealing member 160 liquid-tightly abuts the wall surface of the inner side of the nozzle body portion 131. As described above, the sealing member 160 is provided with a plurality of through-holes through which the light transmission portions 150 are inserted. The light transmission portions 150 are arranged to pass through the through-holes. Spaces between the inner circumferential wall surfaces forming the through-holes of the sealing member 160 and the light transmission portions 150 are filled with the resin 152.

The sealing member 160 has a function of sealing the gap between the portion near the light irradiation portion 150*b* of the light transmission portion 150 and the light-transmissive member 161. The sealing member 160 has a function of sealing the space formed by the outer side surface of the needle valve 135 and the inner side surface of the nozzle body portion 131 on the opposite side of the light-transmissive member 161 from the valve seat 137, and sealing the light transmission portion space 151. Therefore, the sealing member 160 may be a member made of a material that has low hardness and good shape flowability.

The light-transmissive member 161 is a circular plate body formed of quartz glass. A through-hole is formed in the center of the light-transmissive member 161. The wall surface of the outer side of the needle valve 135 is slidably inserted through the through-hole. The light-transmissive member 161 is fitted into the nozzle body portion 131. The material of the light-transmissive member 161 is not limited to quartz glass as long as the light-transmissive member 161 is a member that has a relatively high transmittance to such an extent that light emitted from the light irradiation portion 150*b* can be transmitted and has relatively high compressive strength and heat resistance. As described, above, the end portion of the light irradiation portion 150*b* abuts the upper surface of the light-transmissive member 161. Therefore, the lower ends of the light irradiation portion 150*b* and the resin 152 can be reliably sealed by the light-transmissive member 161. That is, infiltration of the fuel into the space filled with the resin 152 around the light transmission portion 150 (that is, the light transmission portion space 151) from the periphery of the terminal end of the light transmission portion 150 (the light irradiation portion 150*b*) can be sufficiently suppressed.

Although the light transmission portion 150 is buried in the resin 152, there is a possibility that infiltration of the fuel at a relatively high pressure into the light transmission portion space 151 may not be sufficiently suppressed solely by the resin 152. Therefore, in this example, the sealing member (gasket) 160 and the light-transmissive member 161 are provided, and infiltration, of the fuel into the light transmission portion space 151 is suppressed by the sealing member (gasket) 160 and the light-transmissive member 161.

In the valve seat 137, an extension passage (light passage) 137*a* illustrated in FIGS. 2 and 4 is formed. The extension passage 137*a* is a tubular space. The upper end (first end) of the extension passage 137*a* faces the light irradiation portion 150*b* with the light-transmissive member 161 interposed therebetween. The extension passage 137*a* extends downward from the upper end of the extension passage 137*a* and is then bent toward the center axis C100. The lower end (second end) of the extension passage 137*a* communicates with the space S2 in a communication portion 137*a*1 in the vicinity of the lower end of the space S2 (the position immediately above the valve seat portion of the valve seat 137 that the tip corner portion of the needle valve 135 abuts). Therefore, the fuel is supplied to the extension passage 137*a* via the space S2. The extension passage 137*a* is also called a "fuel space" for convenience. The wall surface forming the extension passage 137*a* is subjected to surface processing so as to be a light-reflective surface (specifically, a mirror surface or a surface close to a mirror surface).

Fuel Heating Action of First Fuel Injection Valve

A portion of the light emitted from the light emitting portion 122 directly reaches the light introduction portion 150*a* (the start end of light transmission). The portion of the light emitted from the light emitting portion 122 is concentrated on the light introduction portion 150*a* by the condensing mirror 123 and reaches the light introduction portion 150*a*. The light incident to the inside of the light transmission portion 150 irons the light introduction portion 150*a* passes through the light transmission portion 150, is transmitted to the light irradiation portion 150*b* (the terminal end of the light transmission), and is emitted from the light irradiation portion 150*b*.

As indicated by the arrow B1 in FIG. 4, the light emitted from the light irradiation portion 150*b* passes through the light transmissive member 161 and is incident on the upper end of the extension passage 137*a*. The light incident on the upper end of the extension passage 137*a* is repeatedly reflected by the mirror surface-shaped wall surface forming the extension passage 137*a* and is emitted toward the space S2 from the communication portion 137*a*1. As a result, the fuel present in the space S2 and the extension passage 137*a* is irradiated with the light such that the fuel is heated.

As described above, in the first fuel injection valve 100, the light irradiation portion 150*b* is provided at a position where the space S2 which is relatively small and the extension passage 137*a* which communicates with the space S2 and is a relatively small space are irradiated with light just before the fuel reaches the fuel injection hole 131*a*. Accordingly, the fuel present in the relatively small spaces close to the fuel injection hole 131*a* can be irradiated with light. Therefore, all the fuel present in the relatively small spaces can be efficiently heated by the energy of the light. Furthermore, since the fuel present in the relatively small spaces is heated, the temperature of the heated fuel can be rapidly increased. Moreover, since the distances from the spaces where the fuel is heated (the space S2 and the extension passage 137*a*) to the fuel injection hole 131*a* are relatively short, the temperature of the fuel when the fuel is injected does not decrease. As described above, compared to a case where all the fuel supplied to the first fuel injection valve 100 is heated, the temperature of the injected fuel can be efficiently increased with less energy.

The light-transmissive member 161 is provided between the light irradiation portion 150*b* and the end portion of the extension passage 137*a*. Therefore, the fuel in the extension passage 137*a* is irradiated with the light emitted from the light irradiation portion 150*b* through the light-transmissive member 161, and the space between the light irradiation portion 150*b* and the light transmission portion space 151 can be reliably sealed by the light-transmissive member. As a result, infiltration of the fuel to the periphery of the light transmission portion 150 from the periphery of the light irradiation portion 150*b* can be sufficiently suppressed.

Members for driving the needle valve 135 (that is, valve body driving portions), including the core member 132, the spring 136, the armature 134, the solenoid 139, and the like are provided in the nozzle body portion 131. On the other hand, the light emitting portions 122 are disposed in the base end portion of the nozzle body portion 131 (the end portion on the opposite side to the fuel injection hole 131*a*) on the outer side surface of the second pipe portion 121, which is provided coaxially with the nozzle body portion 131 to be in contact but is a separate body. The light introduction portion 150*a* is disposed on the side of the second pipe portion 121, and the light transmission portion 150 is disposed to extend in parallel to the center axis C100 of the nozzle body portion 131. Therefore, the light emitting portions 122 can be provided in the first fuel injection valve 100 without changing the dimensions of the members related to fuel injection characteristics (that is, the nozzle body portion 131 in which the valve body driving portions are disposed and the needle valve 135). Therefore, the nozzle body portion 131, the valve body driving portions, and the valve body 135 can be made common to a fuel injection valve which is not provided with a light emitting portion and the first fuel injection valve 100. In other words, there is no need to particularly design components (the nozzle portion 130) related to fuel injection in order to provide the light emitting portions 122 in the first fuel injection valve 100. Furthermore, the light source 120 is provided below the first pipe portion 111 provided with the inlet 112, which is an interface for connection to the delivery pipe 41. Accordingly, the first fuel injection valve which is not provided with the light source 120 and the first pipe portion 111 can be used in common. As a result, the cost of the first fuel injection valve 100 can be farther reduced.

In the first fuel injection valve 100, the distance between the light emitting portion 122 and the space S2 where the fuel is heated is long. However, the light transmission portion 150 which transmits light between the light emitting portions 122 and the space S2 with relatively high efficiency is disposed. Therefore, the loss of light energy due to the light transmission can be further reduced. For this reason, the energy efficiency when the fuel is heated can be maintained at a higher value.

In the first fuel injection valve 100, since the light emitting portion 122 is provided at a position where the inner side of the light emitting portion 122 and the outer side surface of the second pipe portion 121 through which the fuel passes are in direct contact with each other, the fuel that passes through the light emitting portion 122 and the second pipe portion 121 can efficiently transfer heat via the second pipe portion 121. The second pipe portion 121 is made of a metal having a higher thermal conductivity than the nozzle body portion 131 and the first pipe portion 111. Therefore, heat generated, by the light emitting portion 122 can be dissipated to the fuel passing through the second pipe portion 121 via the second pipe portion 121, so that the light emitting portion 122 can be efficiently cooled. At the same time, the fuel can be efficiently heated by the heat, so that the temperature of the injected fuel can be efficiently increased with less energy.

The light source 120 includes the reflecting portions (condensing mirrors) 123. Furthermore, the inner surface of the cover portion 124 that covers the light emitting portions 122 and the reflecting portions 123 is a mirror surface. Therefore, in the first fuel injection valve 100, the light generated by the light emitting portion 122 can be efficiently concentrated on the light introduction portion 150*a* by the reflecting portions 123 and the cover portion 124. Accordingly the loss of light energy can be further reduced, and the efficiency of heating the fuel can be further improved.

Second Embodiment

A fuel injection valve according to a second embodiment (hereinafter, referred to as "second fuel injection valve") of the present disclosure will be described. A second fuel injection valve 200 is different from the first fuel injection valve 100 in the following points.

Figure 5:
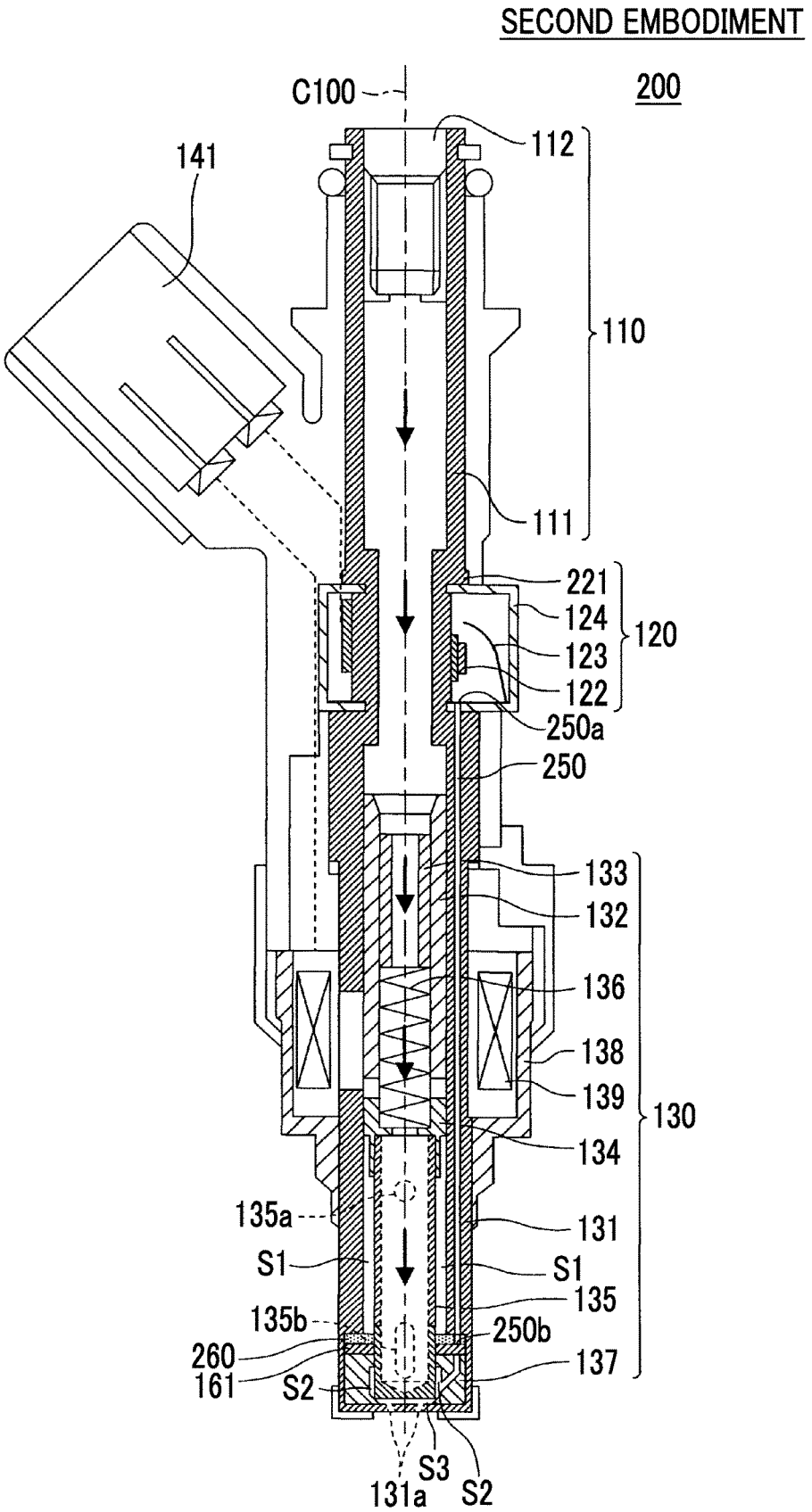
FIG. 5 is a longitudinal sectional view of a fuel injection valve according to a second embodiment (second fuel injection valve) of the present disclosure.

The first fuel injection valve 100 is configured such that the second pipe portion 121 is provided separately from the first pipe portion 111 and the nozzle body portion 131. Contrary to this, as illustrated in FIG. 5, in the second fuel injection valve 200, a second pipe portion 221, the first pipe portion 111 and the nozzle body portion 131 are integrated. That is, the second pipe portion 221 is made of the same material, as a general material forming the first pipe portion 111 and the nozzle body portion 131.

In the first fuel injection valve 100, the metal gasket made of aluminum is used as the sealing member 160. Contrary to this, in the second fuel injection valve 200, as a sealing member 260 instead of the sealing member 160, a gasket made of a metal-coated rubber or resin, which is a material having lower hardness (softness) and better shape followability, is used.

The first fuel injection valve 100 uses the optical fiber as the light transmission portion 150. Contrary to this, in the second fuel injection valve 200, a light transmission portion 250 is a space, and is configured as a space in which the surface forming the space is a mirror surface. The space is also called a light transmission portion space. According to the above description, light can be efficiently transmitted from a light introduction portion 230*a* of the light transmission portion 250 to a light irradiation portion 250*b* of the light transmission portion 250 without preparing new components for light transmission, such as an optical fiber.

Like the first fuel injection valve 100, the second fuel injection valve 200 configured as described above can further improve the efficiency of heating the fuel. Since the second fuel injection valve 200 uses the metal-coated rubber, resin, or the like as the sealing member 260, the gap between the light-transmissive member 161 and the terminal end of the light transmission portion 250 (the light irradiation portion 250*b*) can be reliably sealed, and the light transmission portion 250 (that is, the light transmission portion space) and the space S1 can be reliably shielded from each other. The space S1 is a space formed by the outer side surface of the needle valve 135 and the inner side surface of the nozzle body portion 131 on the opposite side of the light-transmissive member 161 from the valve seat 137. In the second fuel injection valve 200, since the light transmission portion 150 (optical fiber) and the resin 152 for fixing the light transmission portion 150 (optical fiber) can be omitted, the number of components can be reduced compared to the first fuel injection valve 100.

Third Embodiment

A fuel injection valve according to a third embodiment (hereinafter, referred to as "third fuel injection valve") of the present disclosure will be described with reference to FIGS. 6, 7A, and 7B. A third fuel injection valve 300 is different from the first fuel injection valve 100 in the following points. The features of the third fuel injection valve 300 can also be applied to the second fuel injection valve 200.

The third fuel injection valve 300 includes a light source 320 instead of the light source 120 of the first fuel injection valve 100.

The light source 320 includes the second pipe portion 121, light emitting portions 322 (light source), the cover portion 124, and a plurality of condensing mirrors (reflecting portions) 323.

Figure 7A:
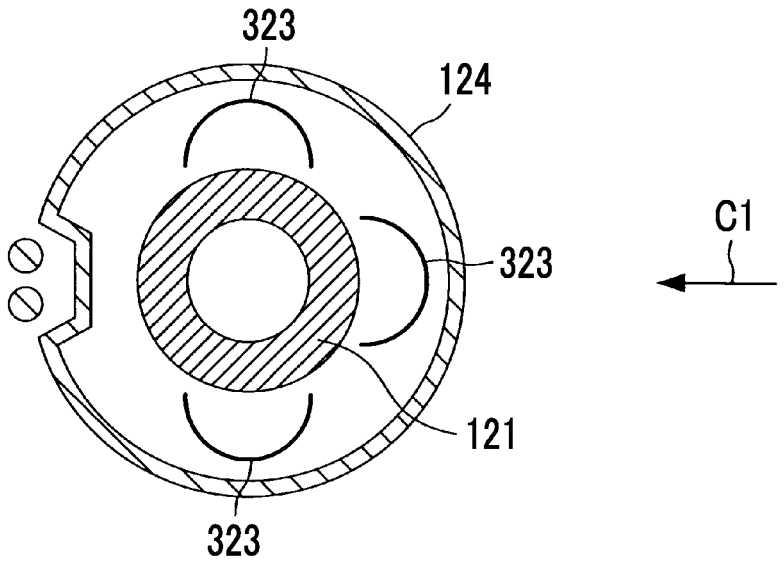
FIG. 7A is a schematic cross-sectional view of the third fuel injection valve out along a plane along line L2 illustrated in FIG. 6.
Figure 7B:
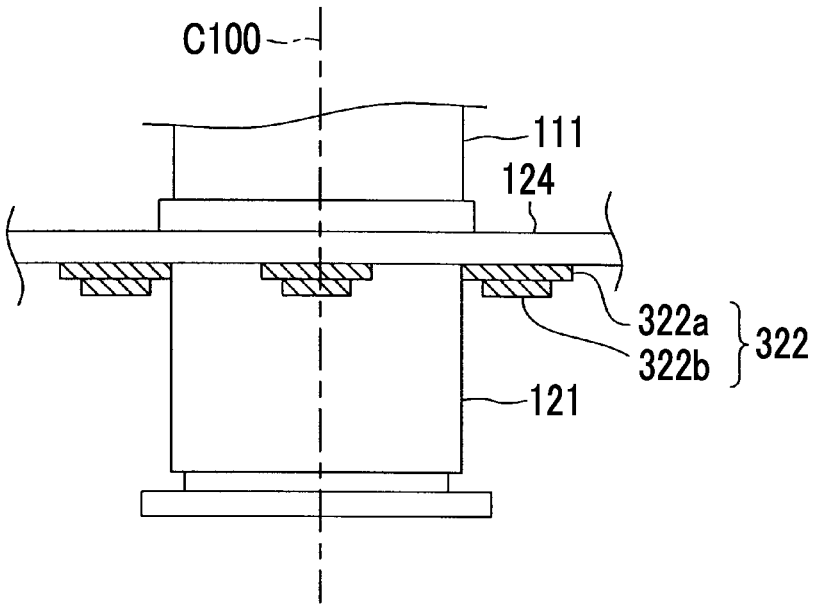
FIG. 7B is a schematic external view of a light emitting portion taken along arrow C1 in FIG. 7A.

Specifically, as illustrated in FIG. 7B, the light emitting portion 322 includes a plurality of sets (in this example, three sets) of a substrate 322*a* and light emitting elements 322*b*. The light emitting element 322*b* is the same LED as the light emitting element 122*b*. FIG. 7B is a view of the light emitting portion 322 taken along arrow C1 in FIG. 7A.

The substrate 322*a* is made of a material having a relatively high heat transfer rate. The substrate 322*a* is provided on the inner surface (lower surface) of the upper wall of a pair of walls perpendicular to the center axis C100 of the cover portion 124. The light emitting element 322*b* is disposed at the lower surface of the substrate 322*a*. A voltage is applied to the light emitting elements 322*b* via wires (not illustrated), and the light emitting elements 322*b* are separated from each other in a circumferential direction. The light emitting element 322*b* emits light downward.

Figure 6:
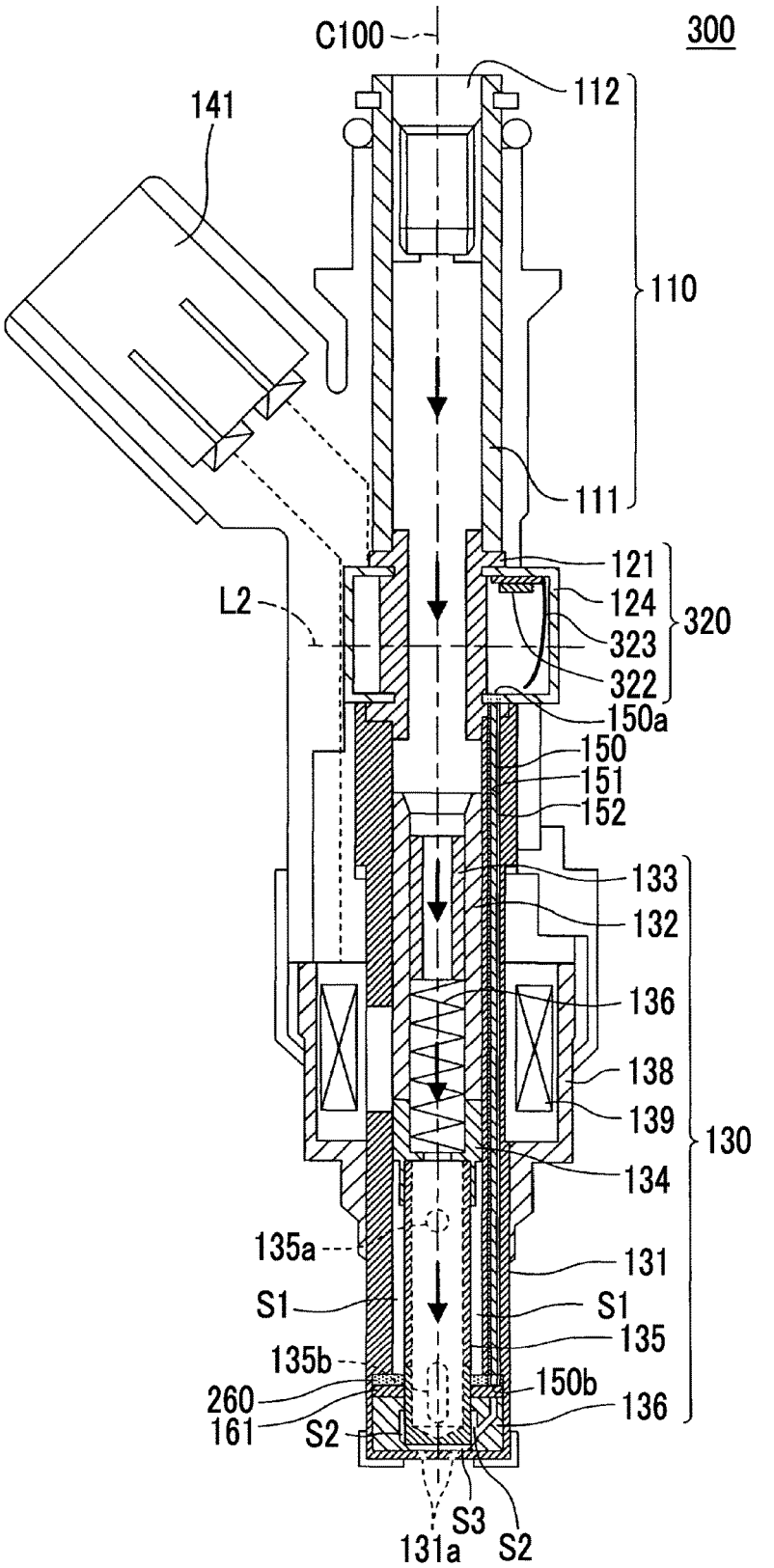
FIG. 6 is a longitudinal sectional view of a fuel injection valve according to a third embodiment (third fuel injection valve) of the present disclosure.

As illustrated in FIGS. 6 and 7A, the condensing mirrors 323 are disposed radially outward of the light emitting, elements 322*b* to respectively correspond to the light emitting elements 322*b*. The light emitting elements 322*b* and the condensing mirrors 323 are accommodated in the space formed by the outer side surface of the second pipe portion 121 and the inner side surface of the cover portion 124.

The condensing mirror 323 is a curved thin plate body and the surface of the condensing mirror 323 is a mirror surface. The condensing mirror 323 has an angle and a shape such that the condensing mirror 323 reflects light emitted from the light emitting element 322*b* and the reflected light is concentrated on the light introduction portion 150*a*.

A portion (inner circumferential end portion) of the cover portion 124 is joined to the second pipe portion 121 having the fuel passage therein, and the light emitting portion 322 is in indirect contact with the second pipe portion 121. Therefore, heat generated by the light emitting portion 322 is dissipated to the fuel via the cover portion 124 and the second pipe portion 121, thereby efficiently cooling the light emitting portion 322. At the same time, the heat generated by the light emitting portion 322 can be effectively used "to heat the fuel in the second pipe portion 121".

The third fuel injection valve 300 operates similarly to the first fuel injection valve 100 and the second fuel injection valve 200, and thus can efficiently heat the fuel to be injected.

Modification Example

While the embodiments of the present disclosure have been described in detail, the present disclosure is not limited to the embodiments described above and can adopt various modification examples within the scope of the present disclosure.

For example, the first to third fuel injection valves 100, 200, 300 have the three light emitting portions but may also have one or two, or four or more light emitting portions.

For example, the first to third fuel injection valves 100, 200, 300 have the single light transmission portion (light irradiation portion) and the single extension passage but may also have two or more light transmission portions (light irradiation portions) and two or more extension passages.

For example, in the first to third fuel injection valves 100, 200, 300, the light irradiation portion 150*b* (250*b*) may be provided at a position where at least a portion of the space S2 and the extension passage 137*a* is irradiated with light transmitted by the light transmission portion 150. In the first to third fuel injection valves 100, 200, 300, the extension passage 137*a* may be omitted. In this case, the light irradiation portion 150*b* (250*b*) may be provided at a position where at least a portion of the space S2 is irradiated with light transmitted by the light transmission portion 150.

For example, in the first to third fuel injection valves 100, 200, 300, instead of the internal space (fuel passage) of the needle valve 135 provided to supply the fuel to the space S2, for example, another fuel passage such as a gap may be provided between the needle valve 135 and the nozzle body portion 131. In this case, the needle valve 135 may have a structure without the internal space (hollow portion) and the through-holes 135*a*, 135*b*.

For example, in the first fuel injection valve 100 or the third fuel injection valve 300, the first pipe portion 111 and the nozzle body portion 131 may be directly joined together, and the light source 120 may be disposed in the first pipe portion 111, or the light source 120 (the second pipe portion 121) may be disposed in the upper portion of the first pipe portion 111. In this case, the light transmission portion 150 is configured to pass through the inside of the wall of the first pipe portion 111 and the inside of the wall of the nozzle body portion 131. Furthermore, in the first to third fuel injection valves 100, 200, 300, the condensing mirrors (reflecting portions) may also be omitted.

What is claimed is:

1. A fuel injection valve comprising:

a nozzle body portion having a hollow columnar shape, the nozzle body portion including a fuel injection hole at a tip portion of the nozzle body portion;

a columnar valve body disposed inside the nozzle body portion to move along an axial direction of the nozzle body portion;

a valve seat disposed in a vicinity of the tip portion inside the nozzle body portion, the valve seat including an accommodation space into which a tip portion of the valve body is inserted;

a valve body driving portion configured to move the valve body between a position where the valve body is seated on a valve seat portion of the valve seat and a position where the valve body is separated from the valve seat portion;

a light source having a light emitting portion which generates light when the light emitting portion is energized;

a pipe portion disposed in a base end portion, which is an end portion on an opposite side to the tip portion of the nozzle body portion in which the fuel injection hole is formed, the pipe portion being disposed coaxially with the nozzle body portion to be in contact but being an integrated body or a separate body and being configured to supply a fuel to the nozzle body portion through the pipe portion; and a light transmission portion configured to receive light generated by the light source from a light introduction portion and transmit the received light to a light irradiation portion to cause the transmitted light to be emitted from the light irradiation portion, wherein:

the valve body and the valve seat define a fuel space which is shielded from the fuel injection hole and is supplied with the fuel in a case where the valve body is in a state of being, seated on the valve seat portion;

the fuel space includes at least a space between a side surface of the valve body and a surface forming the accommodation space of the valve seat;

the valve body and the valve seat are configured to cause the fuel space and the fuel injection hole to communicate with each other in a case where the valve body is in a state of being separated from the valve seat portion;

the light emitting portion is disposed at a position in direct or indirect contact with the pipe portion; and the light irradiation portion is disposed at a position where at least a portion of the fuel space is irradiated with the transmitted light.

2. The fuel injection valve according to claim 1, further comprising a light-transmissive member which is made of a light-transmissive material and is disposed between an outer side surface of the valve body and an inner side surface of the nozzle body portion to be in contact with a surface of the valve seat on the opposite side to the fuel injection hole and close an opening formed by the outer side surface of the valve body and the inner side surface of the nozzle body portion, wherein;

the fuel space includes an extension passage which is provided inside the valve seat and extends from the space to the light-transmissive member; and the light irradiation portion is disposed at a position where the extension passage is irradiated with the transmitted light through the light-transmissive member.

3. The fuel injection valve according to claim 2, wherein:

the light transmission portion includes an optical fiber;

the nozzle body portion includes a light transmission portion space through which the optical fiber passes; and the nozzle body portion includes a resin filling a gap between the optical fiber and a surface forming the light transmission portion space.

4. The fuel injection valve according to claim 3, further comprising a sealing member which seals a space formed by the side surface of the valve body and the inner side surface of the nozzle body portion on the opposite side of the light-transmissive member from the valve seat, and seals the light transmission portion space.

5. The fuel injection valve according to claim 2, wherein:

the light transmission portion is a light transmission portion space formed in the nozzle body portion; and a surface forming the light transmission portion space is a mirror surface.

6. The fuel injection valve according to claim 1, wherein:

the valve body driving portion includes a core member disposed inside the nozzle body portion, a spring disposed inside the nozzle body portion and has a first end that is supported so as not to move relative to the nozzle body portion, an armature which is disposed inside the nozzle body portion to cause a second end of the spring to be locked to the armature and holds the valve body, and a solenoid disposed outside the nozzle body portion to surround an outer circumference of the core member;

the pipe portion is disposed in the base end portion coaxially with the nozzle body portion to be in contact but is a separate body;

the light emitting portion is fixed to an outer side surface of the pipe portion; and the light transmission portion is disposed such that the light introduction portion is disposed at a side of the pipe portion and extends in parallel to a center axis of the nozzle body portion.

7. The fuel injection valve according to claim 6, wherein the pipe portion is made of a material having a higher thermal conductivity than the nozzle body portion.

8. The fuel injection valve according to claim 1, wherein the light source includes a reflecting portion which reflects light emitted from the light emitting portion to cause the light to be concentrated on the light introduction portion.

9. The fuel injection valve according to claim 8, wherein:

the light source includes a cover portion that covers the light emitting portion and the reflecting portion; and an inner surface of the cover portion is a mirror surface.

* * * * *